US010349715B2

(12) United States Patent
Sandy-Hanson

(10) Patent No.: US 10,349,715 B2
(45) Date of Patent: Jul. 16, 2019

(54) EXPANDABLE STORAGE CONTAINER FOR WRITING AND ART IMPLEMENTS

(71) Applicant: Anika Emma Sandy-Hanson, Detroit, MI (US)

(72) Inventor: Anika Emma Sandy-Hanson, Detroit, MI (US)

( * ) Notice: Subject to any disclaimer, the term of this patent is extended or adjusted under 35 U.S.C. 154(b) by 25 days.

(21) Appl. No.: 15/493,967

(22) Filed: Apr. 21, 2017

(65) Prior Publication Data

US 2018/0303212 A1 Oct. 25, 2018

(51) Int. Cl.

| | |
|---|---|
| ***A45C 11/34*** | (2006.01) |
| ***A45C 13/00*** | (2006.01) |
| ***A45C 13/10*** | (2006.01) |
| ***B65D 43/16*** | (2006.01) |
| ***A45C 7/00*** | (2006.01) |

(52) U.S. Cl.

CPC ..... *A45C 11/34* (2013.01); *A45C 7/0054* (2013.01); *A45C 13/005* (2013.01); *A45C 13/10* (2013.01); *B65D 43/16* (2013.01); *A45C 2013/1015* (2013.01)

(58) Field of Classification Search

CPC ..... A45C 11/24; A45C 13/005; A45C 13/10; A45C 2013/1015; A45C 11/34; A45C 7/00; A45C 7/0054; B65D 5/48; B65D 5/48048; B65D 5/52; B65D 5/5253; B65D 43/16; B65D 5/00; B65D 5/008; B65D 5/02; B65D 5/42

USPC ..... 206/214, 215, 224, 371, 425, 256, 206/264–268; 229/67.1, 67.3, 67.4, 229/120.09, 120.08

See application file for complete search history.

(56) References Cited

U.S. PATENT DOCUMENTS

| | | | | | |
|---|---|---|---|---|---|
| 437,042 | A | * | 9/1890 | Peck | B65D 5/5253 229/120.09 |
| 739,844 | A | * | 7/1903 | Gerbereux | B65D 5/5253 229/120.09 |
| 1,047,224 | A | * | 12/1912 | Hodgson | B65D 5/5253 229/120.09 |
| 3,773,245 | A | * | 11/1973 | Meyers | B65D 5/0218 206/264 |
| 4,511,036 | A | * | 4/1985 | Castelli | A45C 13/02 206/371 |

(Continued)

FOREIGN PATENT DOCUMENTS

| | | | | |
|---|---|---|---|---|
| GB | 2439066 | A * | 12/2007 | B65D 5/00 |
| WO | WO-8808602 | A1 * | 11/1988 | B65D 5/48002 |

(Continued)

*Primary Examiner* — Bryon P Gehman

(57) ABSTRACT

A container that is designed to hold within its structure writing and art implements such as crayons, colored pencils, or markers. The container consists of a molded hinged-lid, two hinged-connectors, and three compartments; one on the left, one in the middle, and one on the right. The connectors and hinges allow the compartments to be folded closed or to open away from one another. When closed, the compartments can be held closed by an eye and a loop on the left side. When closed the molded hinged-lid and its curved protruding lip cover the three compartments. The lid can be held closed by a loop in the lid's front and an eye on the right compartment. When open the molded hinged-lid can be held open by the loop in the lid's front and an eye on the back of the middle compartment.

5 Claims, 4 Drawing Sheets

(56) References Cited

U.S. PATENT DOCUMENTS

| | | | | |
|---|---|---|---|---|
| 6,578,706 | B2 * | 6/2003 | Thompson | A45C 3/02 206/214 |
| 6,672,439 | B2 * | 1/2004 | Platte, III | A45C 3/02 206/425 |
| 6,932,202 | B2 * | 8/2005 | Houseberg | B42F 7/145 206/425 |
| 7,086,527 | B2 * | 8/2006 | Mock | A45C 11/34 206/214 |
| 7,527,189 | B2 * | 5/2009 | Billig | B65D 5/6608 229/149 |
| 8,118,160 | B2 * | 2/2012 | Ghini | B65D 85/1063 206/264 |
| 9,254,703 | B2 * | 2/2016 | Kuehn | B42F 7/08 |
| 9,364,062 | B2 * | 6/2016 | Stukenkemper | A45C 11/34 |
| 9,694,933 | B2 * | 7/2017 | Kocon | B65D 5/12 |
| 2007/0235506 | A1 * | 10/2007 | Shapiro | B42F 7/08 229/67.3 |

FOREIGN PATENT DOCUMENTS

| | | | | |
|---|---|---|---|---|
| WO | WO-2010060829 | A1 * | 6/2010 | B65D 85/1036 |
| WO | WO-2013130085 | A1 * | 9/2013 | B65D 85/60 |

* cited by examiner

EXPANDABLE STORAGE CONTAINER FOR WRITING AND ART IMPLEMENTS

BACKGROUND OF THE INVENTION

The present invention pertains to the general field of writing and art implements. More specifically, this invention relates to a container designed to store multiple writing and art implements.

Crayons, colored, pencils, and markers are typically packaged and stored in conventional cardboard boxes that are flimsy, easily destroyed, and difficult for young children to access. In order to reach the contents, children often dump the implements onto their work surface; a process that can result in the implements being broken, jumbled, or lost due to them rolling off the surface. Another significant drawback of the conventional cardboard packaging is that they typically deteriorate prior to the writing and art implements being fully utilized. As the packaging tears or becomes weak, the possibility increases that the implements become broken, jumbled, or lost.

Accordingly, it is an objective of the present invention to overcoming this inefficiency and waste and provide economic benefits for parents, guardians, teachers, and other adults who purchase crayons, colored pencils, and markers.

A second objective is to provide economic benefits for children and equip them to more effectively care for their writing and art implements.

A third objective is to provide a storage container that is child-friendly, simple, economical, durable, and easily accessible.

A fourth objective is to better protect writing and art implements to increase the likelihood that they can be used in their entirety. This is likely to increase access to writing and art implements, particularly for children whose access is limited due to financial and economic challenges.

SUMMARY OF THE INVENTION

It has been established that the need exists for a durable and accessible container for storing multiple writing and art implements. These and other needs are met by the present invention, which is a storage container incorporating a hinged lid, three storage compartments, and two hinged connectors that allow the compartments to fold closed or to be opened away from one another. When the container is being described, the compartments are labeled from the perspective of the individual facing the front of the container. The label "right compartment" is applied to the compartment on the individual's right-hand side and the label "left compartment" is applied to the compartment on the individual's left-hand side. These labels remain constant throughout the description without regard to whether the front, back, top, bottom, or sides of the container are being described. For instance, when the back of the container is facing the individual, the right compartment will be on the individual's left-hand side.

The preferred embodiment of this storage container is constructed of a material that can be either rigid or resilient. It is comprised of a molded hinged-lid, two hinged connectors, and three compartments—one on the left, one in the middle, and one on the right. Each compartment is molded as one continuous rectangular prism without a top. Each compartment has:

- an open top—this serves as the top through which the implements are accessed;

- a narrow face that is opposite from the open top—this face serves as the bottom;
- two narrow faces that are directly across from one another—these serve as the sides; and
- two wide faces that are directly across from one another—one of these faces serves as the back and the other serves as the front.

On the right and left compartments, both the front and back faces have dips that allow easier access to the writing and art implements contained within the compartment. The middle compartment has a dip in the front only; it's back is a continuous rectangle that is joined to the container's top by a hinge.

Preferably, the right compartment is connected to the middle compartment by a connector that is hinged on both sides. This allows the right compartment to lie on top of the middle and left compartments when closed. The middle compartment is connected to the left compartment by a connector that is hinged on both sides and that is slightly shorter than the connector between the right and middle compartments. This allows the left compartment to lie between the middle and right compartments when closed. Both hinged connectors allow the three compartments to swing away from one another in various positions when opened. When closed, the compartments can be held closed by a loop and an eye on the left side. When closed the molded hinged-lid can be held in place by a loop in the lid's front and an eye on the right compartment. When open the molded hinged-lid can be held in place by a loop in the lid's front and an eye on the back of the middle compartment.

Preferably, the molded hinged-lid is kept in place by a loop in its front and one of two eyes. When closed, the lid and its curved protruding lip covers the top portions of all three compartments and the loop connects to an eye attached to the right compartment. When open the lid can be held in place by connecting the loop to an eye attached to the back of the middle compartment.

In addition to the primary objective of the invention, it is also an objective of the invention to produce a storage container that: can be produced in a variety of materials including plastic that is rigid, flexible, opaque, transparent, or colored; is designed so that new implements can be inserted and old ones removed; is easy for a child to use; can be carried in a pocket, pencil case, book-bag, or other school supply; and is cost effective to manufacturer, purchase, and use.

These and other objects and advantages of the present invention will become apparent from the subsequent detailed description of the preferred embodiment and the appended claims taken in conjunction with the accompanying drawings.

BRIEF DESCRIPTION OF THE DRAWINGS

The above description, as well as additional objects and features of the present invention, will be more fully understood by referencing the following detailed descriptions. These descriptions, while illustrative, are the currently preferred embodiments of the present invention when taken in conjunction with the accompanying drawings.

DETAILED DESCRIPTION OF THE INVENTION

Figure 1:
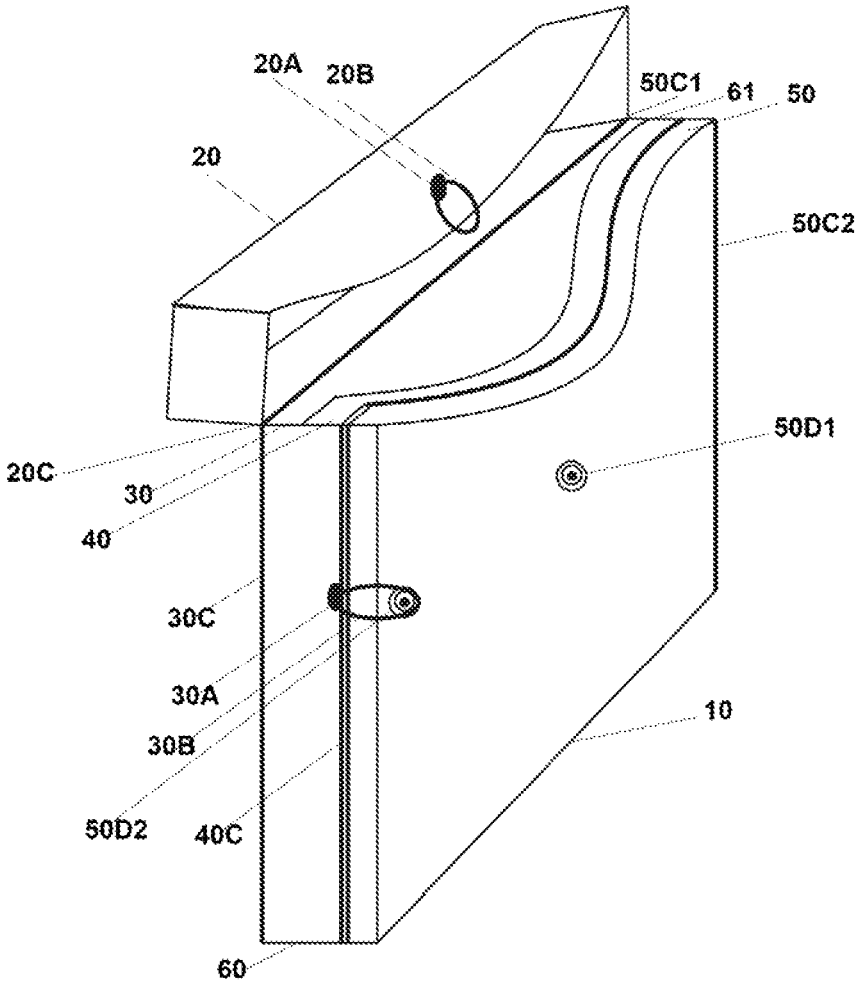
FIG. 1 is a top, left-front perspective view of a first embodiment of the container with the lid in an opened position.
Figure 2:
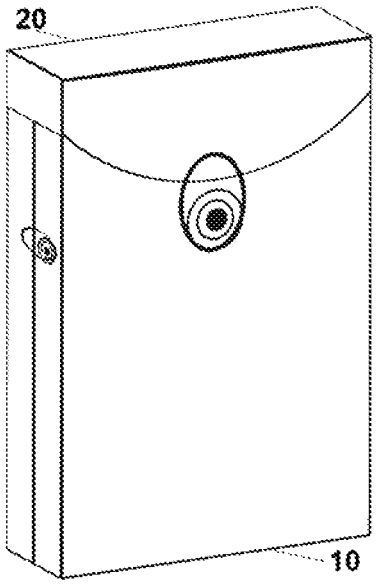
FIG. 2 is a top, left-front perspective view thereof, shown with the lid in a closed position.
Figure 3:
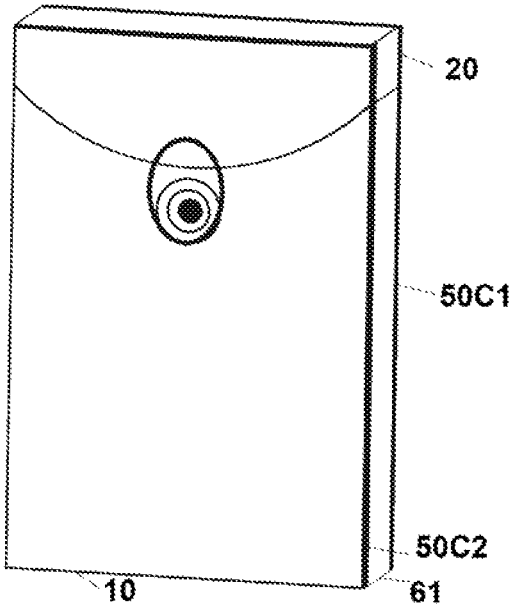
FIG. 3 is a top, right-front perspective view thereof, shown with the lid in a closed position.
Figure 4:
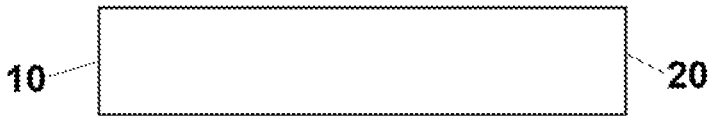
FIG. 4 is a top view thereon.

Referring to the drawings, and in particular to FIGS. 1-8 thereof, therein is a writing and art container according to the present invention, generally designated by the reference number 10. In its basic aspect, the container 10 comprises a hinged top generally designated 20; a stationary middle compartment generally designated 30; a left compartment generally designated 40; and a right compartment generally designated 50.

Figure 6:
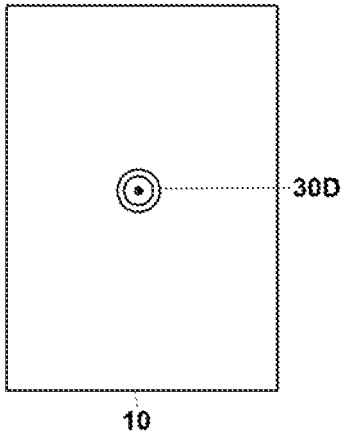
FIG. 6 is a rear view thereon.
Figure 7:
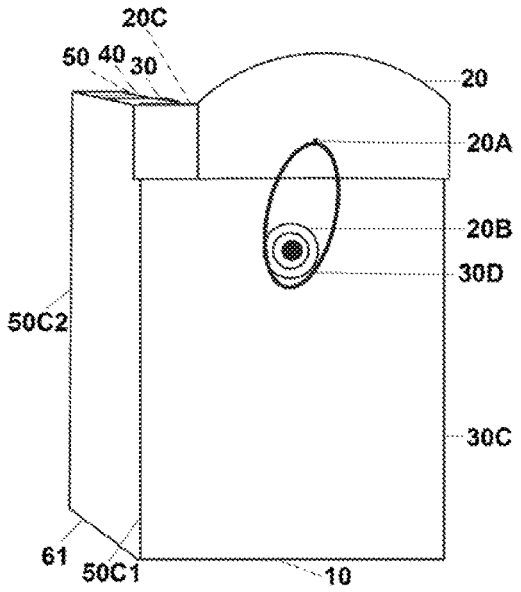
FIG. 7 is a top, right-rear perspective view thereof, shown with the lid in an opened position.
Figure 8:
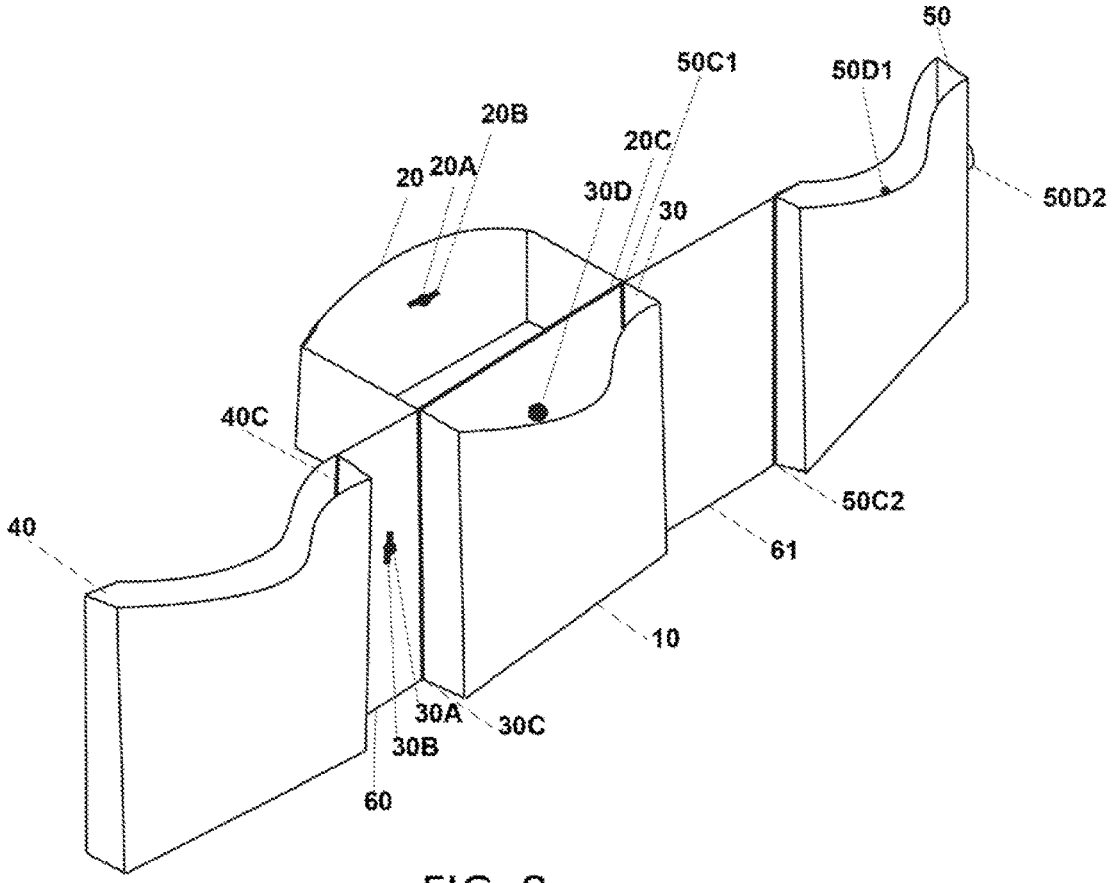
FIG. 8 is a top, left-front perspective view of the container with its three compartments and hinged-lid in open positions.

The hinged top 20, as shown in FIGS. 1-4 can be opened or closed using hinge 20C. When closed the molded hinged-lid 20 and its curved protruding lip covers the top portion of the three compartments and can be held in place by loop 20B in the lid's top and an eye 50D1 located on the right compartment 50. When open the molded hinged lid 20 can be held in place by the loop 20B in the lid's top and an eye 30D on the back of the middle compartment 30 as shown in FIGS. 6-8. The loop 20B is affixed to the hinged top 20 through hole 20A as shown in FIG. 8.

The left compartment 40 is attached to the middle compartment 30 by connector 60 that has hinge 40C on one side and hinge 30C on the other. These two hinges and the connector join the left compartment 40 to the middle compartment 30. Attached to connector 60 is the side closure-loop 30B as shown in FIGS. 1, 2, 7, and 8. The closure-loop 30B is affixed to the connector 60 through hole 30A as shown in FIG. 8.

Figure 5:
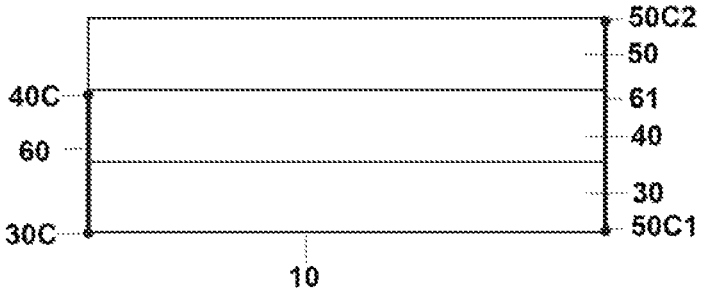
FIG. 5 is a bottom view thereon.

Contained on the right compartment is the side closure-eye 50D2 as shown in FIG. 8. Right compartment 50 is attached to the middle compartment 30 by connector 61 that has hinge 50C1 on one side and hinge 50C2 on the other. These two hinges and the connector join the left compartment 50 to the middle compartment 30. The two connectors and six hinges allow the three compartments to fold on top of one another as shown in FIG. 5.

To summarize, the present invention is a container for storing, protecting, and accessing writing and art implements such as crayons, colored pencils, and markers. The container is designed to prevent waste and loss of implements while being sturdy, child-friendly, simple, and economical. There has been shown and described a novel container which fulfills all of the objects and advantages sought therefore. Many changes, modifications, variations and other uses and applications of the subject invention will, however, become apparent to those skilled in the art after considering the foregoing specification together with the accompanying drawings. All such changes, modifications, variations and other uses and applications which do not depart from the spirit and scope of the invention are deemed to be covered by the invention which is limited only by the claims which follow.

What is claimed is:

1. A storage container for writing and art implements, said storage container comprising:

a plurality of respective storage compartments, said storage compartments comprising a middle compartment and a plurality of side compartments, each compartment including a top opening, said plurality of side compartments comprising a first side compartment and a second side compartment, said middle compartment positioned between said first side compartment and said second side compartment when said storage container is in an open position of the storage container with the compartments separated from one another, a hinged top that covers all of the top openings of said storage compartments when said storage container is in a closed position of the storage container with the storage compartments abutting and on top of one another, the top openings not being covered by said hinged top when said storage container is in the open position, a plurality of connectors, the connectors comprising a first connector connecting the middle compartment to said first side compartment and a second connector connecting said middle compartment to said second side compartment, said plurality of connectors allow said compartments to be moved away from and toward one another, a plurality of hinges, the hinges including a first hinge and a second hinge connecting the first connector to said middle compartment and said first side compartment, and a third hinge and a fourth hinge connecting said middle compartment to said second side compartment, and a fifth hinge connecting said middle compartment to said hinged top, said plurality of hinges allow said compartments and said hinged top to move away from one another to the open position and toward one another to the closed position, said hinged top comprising a protruding lip and a loop provided on a front portion of said hinged top, said second side compartment provided with a first eye for engaging and securing said loop, said hinged top can be secured in the closed position by said protruding lip and engaging and securing said loop and said first eye of said second side compartment, said middle compartment provided with a second eye for engaging and securing said loop, said second eye provided on a back of said middle compartment, said hinged top can be secured in the open position of the hinged top by engaging and securing said loop and said second eye of said middle compartment, said first side compartment provided with a second loop at a side portion of said first side compartment, said second side compartment provided with a third eye for engaging and securing to said second loop of said first side compartment, said plurality of compartments can be secured in the closed position of the storage container by said second loop of said first side compartment engaging and securing said third eye of said second side compartment.

2. The storage container of claim 1, wherein said middle compartment is a rectangular prism with a curved dip in a front portion.

3. The storage container of claim 1, wherein each said storage compartment is molded as a continuous rectangular prism with its opening in a top portion.

4. The storage container of claim 1, wherein said storage compartments each possess an identical volume.

5. The storage container of claim 1, wherein said hinged top is shaped as a wide, short rectangular prism without a bottom and having a curved lip protruding from a front side.

* * * * *